United States Patent [19]

Kanao

[11] 4,176,631

[45] Dec. 4, 1979

[54] INTERNAL COMBUSTION ENGINE

[76] Inventor: Mitsuhiro Kanao, No. 2156-14, Yakeyamacho, Kure-shi, Hiroshima-ken, Japan

[21] Appl. No.: 800,104

[22] Filed: May 24, 1977

Related U.S. Application Data

[62] Division of Ser. No. 689,892, May 25, 1976, Pat. No. 4,106,439.

[30] Foreign Application Priority Data

May 27, 1975 [JP] Japan ..... 50-63636
Aug. 31, 1975 [JP] Japan ..... 50-105755

[51] Int. Cl.[2] ..... F02B 33/04
[52] U.S. Cl. ..... 123/73 PP; 123/73 R; 123/73 A
[58] Field of Search ..... 123/73 R, 73 A, 73 PP, 123/DIG. 4

[56] References Cited

U.S. PATENT DOCUMENTS

| | | | |
|---|---|---|---|
| Re. 27,367 | 5/1972 | Von Seggern et al. | 123/DIG. 4 |
| 1,012,288 | 12/1911 | Stephenson | 123/73 A |
| 1,043,254 | 11/1912 | Russell | 123/73 A |
| 1,870,139 | 8/1932 | Pierotti | 123/73 A |
| 2,317,772 | 4/1943 | Huber | 123/73 A |
| 3,929,111 | 12/1975 | Turner et al. | 123/73 A |
| 4,026,254 | 5/1977 | Ehrlich | 123/73 R |

FOREIGN PATENT DOCUMENTS

| | | | |
|---|---|---|---|
| 584819 | 11/1958 | Italy | 123/73 AA |

*Primary Examiner*—Charles J. Myhre
*Assistant Examiner*—David D. Reynolds
*Attorney, Agent, or Firm*—William Anthony Drucker

[57] ABSTRACT

In operation of an internal combustion engine, a lamina of air is introduced into the combustion chamber to line the wall thereof, the fuel being admitted into the interior of the lamina of air. In a two-stroke engine, air entering the combustion chamber is driven by the incoming fuel mixture to form a lamina which lines the wall of the combustion chamber.

1 Claim, 3 Drawing Figures

INTERNAL COMBUSTION ENGINE

This is a divisional application from my co-pending U.S. patent application Ser. No. 689,892 filed May 25, 1976 now U.S. Pat. No. 4,106,439.

BACKGROUND OF THE INVENTION

This invention relates generally to an internal combustion engine, the combustion of which is improved.

In regard to combustion occurring in internal combustion engines, it is known in the prior art for controlling the various exhaust gases to be advantageous to burn $NO_x$ (oxides of nitrogen) using an excess of fuel so as to lower the average temperature, and to burn off CO (carbon monoxide) using a thin fuel/air mixture.

Another method for decreasing the $NO_x$ and CO consists in maintaining the rich mixture at a high temperature of combustion to control $NO_x$, and secondly to accelerate the oxidization reaction by means of additional air to decrease CO when the temperature is somewhat lowered by progress of the combustion.

According to these proposals, there has already been provided a practical engine in which mixtures supplied as lamina flows are generated and burnt in a form of dual combustion. Another engine is also known having a second chamber, its combustion chamber being divided into a main and an auxiliary chamber, the mixtures being injected into the latter.

These engines have problems in regard to (i) quantity of HC which remains unevaporated and (ii) CO generated by the burning of the non-evaporated HC, because the combustion of these engines is intermittent and performed under a limited rise of temperature.

To find a countermeasure which does not lower the thermal efficiency, it is to adopt single combustion.

In the operation which generates HC and CO through combustion, under present conditions, the gases include a great deal of mixture which flows from the part of the top ring of a piston and which composes quenching zones on the inner wall surface of the cylinder and the upper surface of the piston, during the process of combustion. In an exhaust stroke, a large quantity of waste gases flows out immediately after the valve is opened. HC in the gases is mainly drawn off from a quenching zone on the inner wall surface of the cylinder head. In the later portion of the exhaust stroke, HC and CO on the wall surfaces of the piston and cylinder are carried to the valve while it is open, so that extremely enriched waste gases are exhausted.

It is therefore obvious that the avoiding of generation of HC and CO is impossible at present without a countermeasure which prevents formation of quenching zones on those wall surfaces.

OBJECTS OF THE INVENTION

It is accordingly the object of the present invention to provide an internal combustion engine which forms a lamina of air on the whole inner surfaces of the combustion chamber to prevent generation of quenching zones formed by contact of mixtures with the wall surfaces of the combustion chambers, and which controls formation of HC and CO as well as the quenching zones.

An embodiment of the invention is hereinafter fully described with reference to the accompanying drawings.

SHORT DESCRIPTION OF THE DRAWINGS

In the drawings:

FIGS. 1, 2 and 3 are explanatory schematic vertical sectional views of a two-cycle engine, FIG. 1 showing a stroke of compression and fuel suction, FIG. 2 showing an exhaust stroke and FIG. 3 showing a suction stroke.

DESCRIPTION OF THE PREFERRED EMBODIMENT

In a two-cycle engine in accordance with the present invention, an air ejecting port 22 is provided immediately over a scavenging port (which serves as a supply port in this invention), disposed on the cylinder wall, the air from the ejecting port 22 being blown out upwardly by mixtures ejected from a mixture ejecting port 25 so that an air lamina is produced on the cylinder wall and quenching zones are decreased. Improvement of the effects relating to suction, scavenging and exhaust is also achieved.

Combustion is performed only in air the pressure of which is high. The combustion in the central position of the spherical air lamina is produced at lower temperatures, because the fuel lamina occupying the central position includes less oxygen and nitrogen, and reacts less with air owing to its high concentration. The combustion then develops through average, high and average temperatures and broadens out to the outer lamina, igniting the adjacent portions of the lamina. The flame is finally extinguished by the air lamina which has a low conductivity of heat. The combustion therefore approaches the ideal one.

Figure 1:
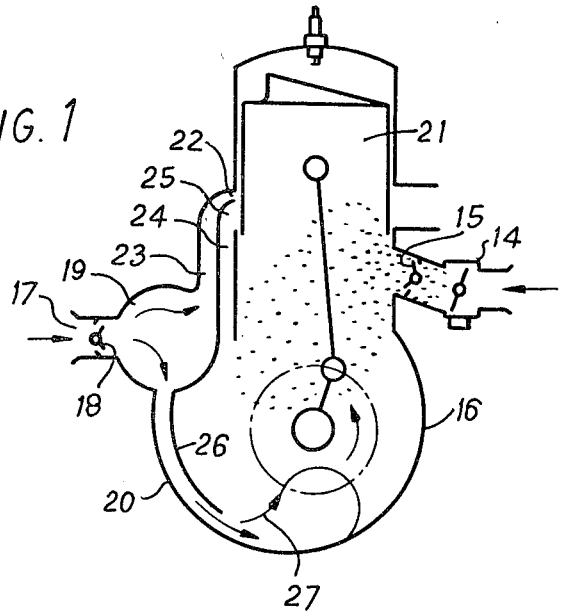

FIG. 1 shows an example, in which a stroke of compression and suction of fuel including air is illustrated. Enriched mixtures sucked from a carburretor 14 enters a crank case 16 through a free mushroom-type automatic valve 15. Air sucked from an air supply port 17 enters an air chamber 19 through a free mushroom-type automatic valve 18. A part of the air enters a crank case 16 through an associated air running port 20 as shown by arrow 27.

A piston 21 is then lowered to open the air ejecting port 22 in an expansion stroke. Internal pressure caused in the crank case 16 by the lowering motion of the piston 21 presses back a small quantity of air flowing from the port 20 to the crank case 16 into the original port 20, and the compressed air passes through the air chamber 19 and a flue 23, so as to pass as a jet, into the cylinder from the ejecting port 22, by which operation the burnt waste gas is exhausted into the atmosphere as shown in FIG. 2.

Next, the further lowered piston 21 opens a mixture ejecting port 25. The mixture in the crank case 16 passes through a supply flue 24 to pass as a jet into the cylinder from the mixture ejecting port 25, and the mixture blows out upwardly the air coming from the air ejecting port 22 at the same time. During this time, waste gases remaining on the cylinder surface are exhausted into the atmosphere as shown in FIG. 3, and an air lamina is accordingly produced on the cylinder wall surface.

Figure 2:
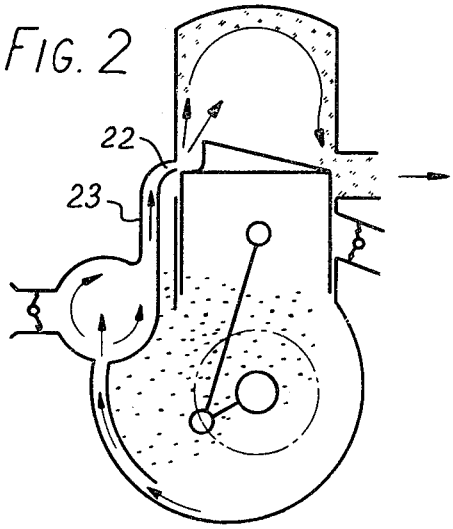
Figure 3:
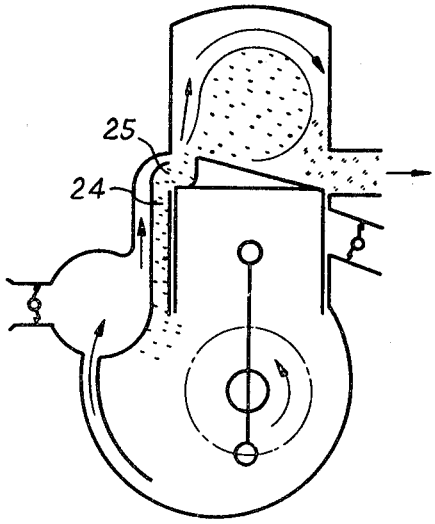

In FIGS. 1–3, reference number 26 designates a guide plate which constitutes the associated air running port 20, serving to prevent confluence of air in the air chamber 19.

The air lamina is generated on the whole of the surface of the combustion chamber, and the combustion is performed with less quenching zones on the inner surface of the cylinder wall as a result, and the amount of HC, CO and NO exhausted is decreased. An internal combustion of high thermal efficiency is thus obtainable.

The mixture may be constituted with air and a solution of ammonia, alcohol and the like, amine and the like, ammonium and the like, sodium or potassium each dissolved in water or other solvent. As the other gas for the mixture there may be selected steam, ammonia, alcohol and the like, hydrocarbon, oxygen, hydrogen etc., these being mainly used for controlling oxides of nitrogen.

As a countermeasure against $NO_x$, there are special methods of contact reduction and absorption, both using ammonia gas, ammonia water and alkaline water in addition to mixing of air.

Assuming that the nitrogen is oxidized in successive stages, e.g. $N_2O$-NO-$NO_2$, the following formulae are obtained:

$$N_2+\tfrac{1}{2}O_2=N_2O,\ N_2O+\tfrac{1}{2}O_2=2NO,$$

and $$2NO+O_2=2NO_2.$$

Supposing that $NO_x$ is produced at any moment, $$N_2+\tfrac{1}{2}O_2=N_2O,\ N_2+O_2=2NO,$$

and $$\tfrac{1}{2}N_2+O_2+NO_2.$$

These reactions are presumed to be physical chemistry reactions at high temperatures, so that heat and combustion velocity controlling and chemical treatment appear to be performed simultaneously for controlling the waste gas.

First, the reaction of $NO_x$ and ammonia is shown as follows:

$$3N_2O+2NH_3\rightarrow 4N_2+3H_2,$$

$$3NO+2NH_3\rightarrow (5/2)N_2+3H_2O,$$

and $$3NO_2+4NH_3\rightarrow 3\tfrac{1}{2}N_2+6H_2O.$$

Presuming that ammoniated nitric acid is produced, $$2NO_2+2NH_3\rightarrow NH_4NO_3+N_2+H_2O,$$

$$2NO_2+2NH_4OH\rightarrow NH_4NO_2+NH_4NO_3+H_2O,$$

and $$NO+NO_2+2NH_4OH\rightarrow 2NH_4NO_2+H_2O.$$

An absorption method using sodium or potassium is shown as follows:

$$4NO+2NaOH\rightarrow N_2O+2NaNO_2+H_2O,$$

$$6NO+4NaOH\rightarrow N_2+4NaNO_2+H_2O,$$

and $$2NO_2+2NaOH\rightarrow NaNO_2+NaNO_3+H_2O.$$

Reaction of $NO_x$ and Hydrogen produced by decomposition of ammonia or hydrocarbon is as follows:

$$2NO+\rightarrow 2NH_3+2H_2O,$$

$$NO+H_2\rightarrow \tfrac{1}{2}N_2+H_2O,$$

$$NO_2+3\tfrac{1}{2}H_2\rightarrow NH_3+2H_2O,$$

and $$NO_2+2H_2\rightarrow \tfrac{1}{2}N_2+2H_2O.$$

Reaction of waste gas and ammonia is $$1\tfrac{1}{2}O_2+2NH_3\rightarrow N_2+3H_2O,$$

and $$H.CHO+2NH_3\rightarrow N_2+CH_4+H_2+H_2O.$$

These reactions are effected simultaneously. In oxidization, if any chemical agents are decomposed by the combustion, controlling $NO_x$ has no effect. Adding appropriate agents to $H_2O$ then prevents the decomposition of the agents by the combustion temperature. It is intended to control the temperature by water and prevent the decomposition of the agents.

In that case, a great deal of vaporized water or atomized water, including an agent which makes the vaporizing efficiency high, is sucked through a suction valve for multiple uses. This is intended to utilize a part of the steam pressure to give torque in the engine. The high pressure steam is produced in the cylinder by the heat of combustion of fuel from a great deal of evaporated water which is sucked into the fuel, such as hydrocarbon or especially hydrogen, acetylene etc., the combustion temperatures of which are very high.

I claim:

1. A two-stroke internal combustion engine comprising:

(i) a cylinder (ii) a piston movable in said cylinder and defining a combustion chamber therein (iii) a crank-case having an arcuate face (iv) an air chamber disposed laterally at the upper part of said crank-case (v) an air inlet on said air chamber, said air inlet having thereon a non-return air inlet valve for said air chamber (vi) a guide plate spaced from and extending along said arcuate face of said crank-case so as to define therewith an air flow passageway opening at one end into said air chamber and continually open at the other end into the lower portion of said crank-case (vii) means in said crank-case and cylinder defining a combustible mixture ejecting port communicating at one end with said crank-case and at the other end with said combustion chamber, said port being opened at said other end when the piston is at and approaching bottom dead centre position (viii) a passage-forming means defining an air ejecting port communicating at one end with said air chamber and at the other end with said combustion chamber adjacent to said mixture ejecting port said air ejecting port being positioned above said mixture ejection port and directed in relation to said mixture ejecting port such that, upon opening of said mixture ejecting port subsequent to the opening of said air ejecting port during passage of said piston during a downstroke, air forced by said piston from said crank-case through said air passageway into said air chamber and thence through said air ejecting port into said combustion chamber is impinged on by fuel mixture ejected by said piston from said crank-case through said mixture ejecting port and is thereby constrained to flow along the wall of the cylinder and form over the whole of said wall a lamina within which said ejected fuel mixture is contained.

* * * * *